US009988241B2

(12) United States Patent
Lehtinen

(10) Patent No.: US 9,988,241 B2
(45) Date of Patent: Jun. 5, 2018

(54) HOISTING ROPE AND HOISTING APPARATUS

(71) Applicant: KONE Corporation, Helsinki (FI)

(72) Inventor: Hannu Lehtinen, Helsinki (FI)

(73) Assignee: KONE CORPORATION, Helsinki (FI)

( * ) Notice: Subject to any disclaimer, the term of this patent is extended or adjusted under 35 U.S.C. 154(b) by 0 days. days.

(21) Appl. No.: 15/492,542

(22) Filed: Apr. 20, 2017

(65) Prior Publication Data

US 2017/0217729 A1 Aug. 3, 2017

Related U.S. Application Data

(63) Continuation of application No. PCT/FI2015/050742, filed on Oct. 28, 2015.

(30) Foreign Application Priority Data

Nov. 3, 2014 (EP) ..... 14191398

(51) Int. Cl.

| | |
|---|---|
| ***B66B 7/06*** | (2006.01) |
| ***D07B 1/14*** | (2006.01) |
| ***B66B 9/00*** | (2006.01) |
| ***D07B 1/22*** | (2006.01) |

(52) U.S. Cl.

CPC ..... *B66B 7/062* (2013.01); *B66B 9/00* (2013.01); *D07B 1/142* (2013.01); *D07B 1/22* (2013.01); *D07B 2201/1092* (2013.01); *D07B 2205/3003* (2013.01); *D07B 2205/3007* (2013.01); *D07B 2501/2007* (2013.01)

(58) Field of Classification Search

CPC .. D07B 1/162; D07B 1/22; D07B 2501/2007; B66B 7/062

See application file for complete search history.

(56) References Cited

U.S. PATENT DOCUMENTS 1,998,816 A * 4/1935 Meyer ..... B29D 29/10 156/141
2008/0078157 A1* 4/2008 Dold ..... B66B 7/06 57/212

(Continued)

FOREIGN PATENT DOCUMENTS

EP 1 334 943 A1 8/2003
WO WO-2009090299 A1 * 7/2009 ..... B66B 7/062

(Continued)

*Primary Examiner* — Michael R Mansen

(74) *Attorney, Agent, or Firm* — Birch, Stewart, Kolasch & Birch, LLP

(57) ABSTRACT

A hoisting rope for a hoisting apparatus has a longitudinal direction, a thickness direction and a width direction, and includes a group of load bearing members made of composite material comprising reinforcing fibers embedded in polymer matrix; and a coating encasing the group of load bearing members; wherein the load bearing members extend in an untwisted manner inside the coating parallel with each other as well as with the longitudinal direction of the rope throughout the length thereof, the load bearing members being substantially larger in width direction than in thickness direction of the rope and stacked against each other in thickness direction of the rope. An elevator includes the hoisting rope.

18 Claims, 2 Drawing Sheets

(56) References Cited

U.S. PATENT DOCUMENTS

| | | | | |
|---|---|---|---|---|
| 2008/0277206 | A1* | 11/2008 | Veronesi | B66B 7/06 187/251 |
| 2011/0000746 | A1 | 1/2011 | Pelto-Huikko et al. | |
| 2011/0240408 | A1* | 10/2011 | Wesson | B66B 7/062 187/251 |
| 2011/0259677 | A1 | 10/2011 | Dudde et al. | |
| 2012/0195733 | A1 | 8/2012 | Bruch et al. | |

FOREIGN PATENT DOCUMENTS

| | | | |
|---|---|---|---|
| WO | WO 2011/029726 | A2 | 3/2011 |
| WO | WO 2011/029726 | A3 | 5/2011 |
| WO | WO 2012/168007 | A1 | 12/2012 |

* cited by examiner

HOISTING ROPE AND HOISTING APPARATUS

CROSS REFERENCE TO RELATED APPLICATIONS

This application is a Continuation of PCT International Application No. PCT/FI2015/050742, filed on Oct. 28, 2015, which claims priority under 35 U.S.C. 119(a) to Patent Application No. 14191398.8, filed in Europe on Nov. 3, 2014, all of which are hereby expressly incorporated by reference into the present application.

FIELD OF THE INVENTION

The invention relates to a hoisting rope and a hoisting apparatus. Said hoisting apparatus is preferably an elevator for transporting passengers and/or goods.

BACKGROUND OF THE INVENTION

Hoisting ropes typically include one or several load bearing members that are elongated in the longitudinal direction of the rope and each form a structure that continues unbroken throughout the length of the rope. Load bearing members are the members of the rope which are able to bear together the load exerted on the rope in its longitudinal direction. The load, such as a weight suspended by the rope, causes tension on the load bearing member in the longitudinal direction of the rope, which tension can be transmitted by the load bearing member in question all the way from one end of the rope to the other end of the rope. Ropes may further comprise non-bearing components, such as an elastic coating, which cannot transmit tension in the above described way. The coating can be utilized for one or more purposes. For instance, the coating can provide rope with a surface via which the rope can effectively engage frictionally with a drive wheel. The coating can also be used to provide protection for the load bearing members of the rope.

Such hoisting ropes have been suggested where the load bearing members are in the form of elongated fiber-reinforced composite members encased in polymer coating. Composite material of this kind is typically rigid in all directions and thereby also difficult to bend. In hoisting appliances, ropes typically need to be guided by rope wheels, whereby each rope goes through bending during its use. The bending is repeated constantly during the use of the hoisting appliance, whereby internal behavior of the rope during bending is an important factor in service life of the rope. As it is normally desired that the ropes have a maximally long service life, it is not recommendable to guide the rigid ropes around so small-radius rope wheels that a too sharp bending would be caused for the rope in question. Sharp bends might cause local internal stresses on the load bearing member that could be damaging for the load bearing member or at least shorten the service life of the load bearing member in long term use. One or more of the above given aspects of rope behavior in bending, among several other aspects, need to be taken into account when designing the layout of the elevator and selecting the size of the rope wheels. A drawback has been that this limits the freedom of design of the elevator. In general, the thicker the cross section of the load bearing members are, the larger the bending radius should be. Thus, the designer has been limited to a certain size range of a rope wheel when selecting a rope wheel for a given load bearing cross section.

BRIEF DESCRIPTION OF THE INVENTION

The object of the invention is to introduce a hoisting rope, and a hoisting apparatus which is improved in terms of its behavior in bending. The object of the invention is, inter alia, to solve previously described drawbacks of known solutions and problems discussed later in the description of the invention. An object is particularly to introduce a solution whereby load bearing cross section can be large in thickness direction of the rope, in cases where the rope is to be bent around an axis extending in width direction of the rope. Improvements are presented, inter alia, which can be utilized for one or more of the following: for making the load bearing cross sectional area of a rope large in thickness direction, for making a rope bendable around smaller diameter wheels, and for making the internal structure of the rope well adaptable to stresses. Advantageous embodiments are further presented, inter alia, wherein the internal structure of the rope is able to adapt in the bending situation by 'laminar' movement between load bearing members next to each other.

It is brought forward a new hoisting rope for a hoisting apparatus such as an elevator, the hoisting rope having a longitudinal direction, thickness direction and width direction, and comprising a group of load bearing members made of composite material comprising reinforcing fibers embedded in polymer matrix; and a coating encasing said group of load bearing members; wherein said load bearing members extend in an untwisted manner inside the coating parallel with each other as well as with the longitudinal direction of the rope throughout the length thereof, said load bearing members being substantially larger in width direction than in thickness direction of the rope and stacked against each other in thickness direction of the rope. With this structure, one or more of the advantages/objects of the invention are achieved. In particular, there being load bearing members stacked against each other in thickness direction of the rope, the load bearing cross sectional area of the rope can be large in thickness direction of the rope without challenges with internal stresses. This is, because thanks to the stacked structure, the load bearing cross section is divided into load bearing layers which are on top of each other in thickness direction. The thickness of each of the load bearing members is smaller than the overall thickness of the stacked load bearing members. Thereby, internal stresses are divided into a plurality of separate load bearing members instead e.g. of one larger load bearing member, which provides an interface between each pair of load bearing members next to each other in thickness direction of the rope where internal stresses are at least to some amount released.

In a preferred embodiment, the number of load bearing members in said group is at least 2. Preferably, the number is then less than 10. With small number of load bearing members in the group G, a considerable addition for the thickness of the load bearing cross section is obtained with simple structure. When the number of load bearing in said group is in the range of at least 2 less than 10, most preferably but not necessarily, the thickness of each individual load bearing member is within range 0.5-4 mm and their combined thickness is between 1 to 20 mm.

In a preferred embodiment, the number of load bearing members in said group is 2. Thereby, with minimal number of stacked load bearing members, and thereby with simple structure, a great effect is obtained. In another preferred embodiment, the number of load bearing members in said group is 3 whereby with simple structure a great effect is also obtained.

In a preferred embodiment, the rope is substantially larger in its width direction than in its thickness direction. The width/thickness—ratio of the rope is preferably at least 2. Thus, the attitude of the rope, and the bending direction thereof, can be reliably controlled.

In a preferred embodiment, width/thickness—ratio of the load bearing members is at least 2. Thereby they maintain their position within the rope and support each other firmly.

In a preferred embodiment, the load bearing members next to each other in thickness direction have opposing sides, i.e sides facing in thickness direction of the rope towards each other, placed against each other, which sides are shaped to form counterparts for each other. Thereby they can be easily stacked and they can effectively give support for each other during use.

In a preferred embodiment, said opposing faces are flat. Thereby, these sides can be arranged to rest against each other with simple structure and large area, at the same time facilitating moveablity between them in longitudinal direction of the rope.

In a preferred embodiment, the coating forms the external surface of the rope. Thus, the rope is provided with a surface via which the rope can effectively engage frictionally with a drive wheel, if desired. Thus, it is also possible to provide the load bearing members with protection as well as friction properties adjustable to perform well in the intended use, for instance in terms of traction.

In a preferred embodiment, the coating may have a contoured shape, such as polyvee pattern of longitudinal grooves and ribs, on one or both of its sides facing in thickness direction of the rope, or a tooth pattern of teeth extending at least substantially in transverse direction of the rope, on one or both of its sides facing in thickness direction of the rope.

In a preferred embodiment, the load bearing members are provided for moving relative to each other in longitudinal direction of the rope within the hoisting rope by sliding against each other in longitudinal direction of the hoisting rope. This can be facilitated in one or more ways, such as by smooth shaping of the opposing sides, by lubrication or by material selection of the faces. Said opposing sides placed against each other are preferably unattached to each other so movement is allowed without first breaking of an attachment between them.

In a preferred embodiment, said opposing sides are unattached to each other.

In a preferred embodiment, the rope contains lubricant for lubricating the interface between load bearing members next to each other in thickness direction of the rope.

In a preferred embodiment, said opposing faces are placed against each other directly and/or indirectly via nothing but a layer of lubricant between them.

In a preferred embodiment, the coating material does not extend between the load bearing members stacked against each other.

In a preferred embodiment, one or both of the load bearing members next to each other in thickness direction has/have an outer layer of low friction material, such as Teflon (Polytetrafluoroethylene; PTFE) for example, forming the side thereof which faces the load bearing member next to it in thickness direction of the rope.

In a preferred embodiment, the coating is elastic, thereby allowing relative movement between the load bearing members in longitudinal direction of the rope.

In a preferred embodiment, the coating is molded around the group of load bearing members such that it is attached to the periphery of the group of load bearing members.

In a preferred embodiment, the opposing sides placed against each other are smooth at least in the longitudinal direction of the rope.

In a preferred embodiment, said reinforcing fibers are carbon fibers but also other fibers can be used, such as glass fibers. Also preferably, all the individual reinforcing fibers of the load bearing member are bound to each other by the matrix.

In a preferred embodiment, the matrix comprises epoxy.

In a preferred embodiment, the reinforcing fibers of each load bearing member are substantially evenly distributed in the polymer matrix of the load bearing member in question. Furthermore, preferably, over 50% of the cross-sectional square area of the load bearing member consists of said reinforcing fibers. Thereby, a high tensile stiffness can be facilitated. Preferably, the load bearing members cover together over proportion 50% of the cross-section of the rope.

In a preferred embodiment, the module of elasticity E of the polymer matrix is over 2 GPa, most preferably over 2.5 GPa, yet more preferably in the range 2.5-10 GPa, most preferably of all in the range 2.5-3.5 GPa. In this way a structure is achieved wherein the matrix essentially supports the reinforcing fibers, in particular from buckling. One advantage, among others, is a longer service life. In the context of this kind of material the stacked structure is particularly advantageous as the downsides of rigidity in bending can thus be alleviated.

In a preferred embodiment, substantially all the reinforcing fibers of each load bearing member are parallel with the longitudinal direction of the load bearing member. Thereby the fibers are also parallel with the longitudinal direction of the rope as each load bearing member is oriented parallel with the longitudinal direction of the rope. This facilitates further the longitudinal stiffness of the rope. In the context of this kind of material the stacked structure is particularly advantageous as the downsides of rigidity in bending, caused by said stiffness, can thus be alleviated.

In a preferred embodiment, the coating comprises for the group an inside space closed in transverse direction of the rope wherein said group of load bearing members is contained, and in the inside space no other load bearing members, and preferably nor any other solid components, than said load bearing members of said group are contained.

In a preferred embodiment, the group comprises only, i.e. no other load bearing members than, said load bearing members stacked against each other in thickness direction of the rope. In this case, in the group there are no load bearing members adjacent each other in width direction of the rope.

In a preferred embodiment, the rope comprises a plurality of groups of load bearing members as defined adjacently in width direction of the rope. For example the number of said groups can be 2 to 10.

In a preferred embodiment, said same coating encases each group of load bearing members.

In a preferred embodiment, the groups are spaced apart in width direction of the rope the coating extends between groups next to each other isolating the groups from each other. Thereby the coating forms a common coating for all of the groups of load bearing members which encases all these groups. The coating preferably surrounds (in transverse direction) each of said groups and fills space(s) that exist in width direction between adjacent groups. The groups and the load bearing members thereof are untwisted and parallel with each other and with the rope.

In a preferred embodiment, the number of load bearing members in said group is greater than what was described above, in particular from ten to one hundred. Then, most preferably but not necessarily, the thickness of each individual load bearing member is within range 0.1-2 mm and their combined thickness is between 1 to 20 mm.

In a preferred embodiment, the stacked structure is used for making an individual rope slim. Using a composite material with rigid matrix having module of elasticity E of the polymer matrix over 2 GPa, most preferably over 2.5 GPa, yet more preferably in the range 2.5-10 GPa, most preferably of all in the range 2.5-3.5 GPa, enables stacking a greater number of load bearing members, preferably at least 5 load bearing members, against each other even to such extent that the overall thickness is reached which makes the thickness of the rope greater than the width thereof, the width/thickness-ratio of the rope being at most 1. This would not be feasible with elastic matrix as the tension of the outermost load bearing parts in a rope suspending the car would compress the innermost ropes excessively against the rope wheels. The resulting advantage would then be that the high overall thickness contributes in making the overall width of the rope bundle slim, because individual ropes would not be wide anymore.

It is also brought forward a new hoisting apparatus comprising one or more hoisting ropes as defined above or elsewhere in the application, such as in the claims. The hoisting rope may contain one or more of the preferred features in any combination. The hoisting apparatus brought forward is most preferably an elevator. The elevator preferably comprises a hoistway; an elevator car vertically movable in the hoistway; a counterweight vertically movable in the hoistway; a roping comprising one or more of said hoisting ropes, each interconnecting the elevator car and counterweight.

In a preferred embodiment, each of said one or more ropes pass around one or more rope wheels mounted in proximity of the upper end of the hoistway, such as inside the upper end of the hoistway or inside a space beside or above the upper end of the hoistway.

In a preferred embodiment, said one or more rope wheels comprise a drive wheel engaging said one or more ropes; and the elevator comprises a motor for rotating the drive wheel, and an elevator control unit for automatically controlling rotation of the motor.

In a preferred embodiment, each rope passes around said one or more rope wheels turning around an axis extending in width direction of the rope.

In a preferred embodiment, each of said one or more ropes passes around the one or more rope wheels the side thereof which faces in thickness direction and extends in width direction of the of the rope, resting against the rope wheel.

The hoisting apparatus is preferably and elevator. The elevator is preferably such that the car thereof is arranged to serve two or more landings. The elevator preferably controls movement of the car in response to calls from landing and/or destination commands from inside the car so as to serve persons on the landing(s) and/or inside the elevator car. Preferably, the car has an interior space suitable for receiving a passenger or passengers, and the car can be provided with a door for forming a closed interior space.

BRIEF DESCRIPTION OF THE DRAWINGS

In the following, the present invention will be described in more detail by way of example and with reference to the attached drawings, in which.

DETAILED DESCRIPTION

Figure 1:
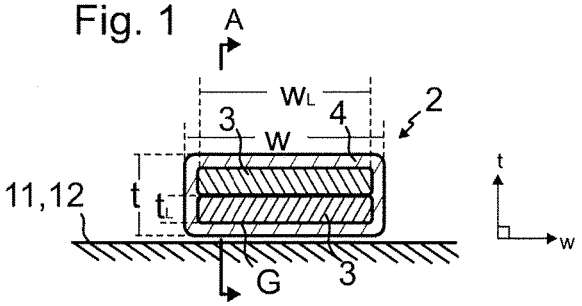
FIG. 1 illustrates a cross section of a rope as viewed in longitudinal direction of the rope according to a first embodiment.
Figure 1A:
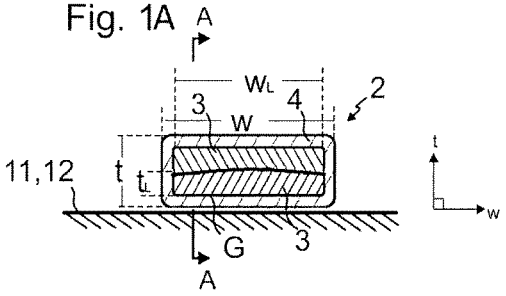
FIG. 1*a* illustrates a cross section of a rope as viewed in longitudinal direction of the rope according to a first embodiment, in which a first load bearing member includes a concave shaped side adjacent to a convex shaped side of a second load bearing member.
Figure 2:
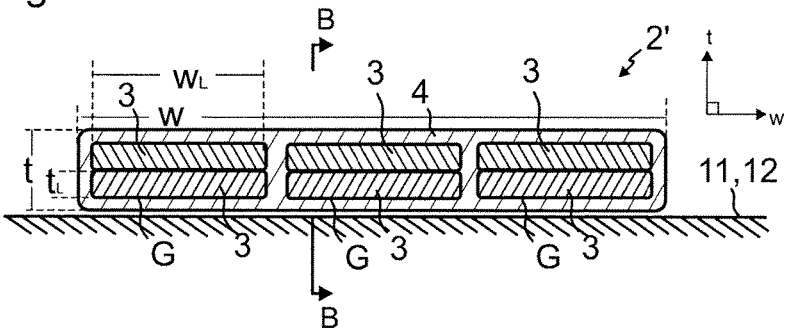
FIG. 2 illustrates a cross section of a rope as viewed in longitudinal direction of the rope according to a second embodiment.
Figure 3:
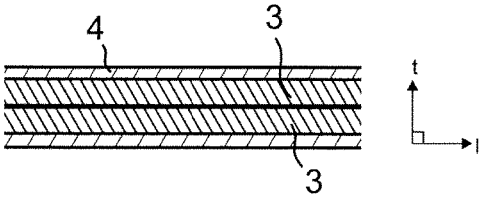
FIG. 3 illustrated cross section A-A of FIG. 1 and cross section B-B of FIG. 2.

FIGS. 1 and 2 each illustrate an embodiment of a hoisting rope 2,2'. In each case, the hoisting rope 2,2' has a longitudinal direction I, thickness direction t and width direction w, and comprises a group G of load bearing members 3 and a coating 4 encasing said group G of load bearing members 3. The load bearing members 3 extend inside the coating 4 parallelly, to be more precise parallelly with respect to each other as well as with the longitudinal direction I of the rope 2,2', and in an untwisted manner unbroken throughout the length of the rope 2,2'. The load bearing members 3 are belt-shaped, and thereby substantially larger in width direction w than in thickness direction of the rope 2,2', and made of composite material comprising reinforcing fibers F in polymer matrix m. The load bearing members 3 are stacked against each other in thickness direction t of the rope 2,2'. Thanks to the stacked structure, the load bearing cross section is divided into load bearing layers which are on top of each other in thickness direction. The thickness of each of the load bearing members is smaller than the overall thickness of the stacked load bearing members 3. Thereby, internal stresses are divided into a plurality of separate load bearing members instead e.g. of one larger load bearing member. Thereby an interface, or in other words an discontinuity of load bearing material, is provided between each pair of load bearing members 3, which are next to each other in thickness direction of the rope 2,2'. This increases adaptability of the rope structure to stresses.

The load bearing members 3 being substantially larger in width direction w than in thickness direction t of the rope hoisting 2,2', they become easy to stack against each other in thickness direction t of the hoisting rope 2,2' as well as maintain the architecture of the hoisting rope 2,2' unchanged during use of the hoisting rope 2,2'. Furthermore, the load bearing members 3 being substantially larger in width direction w than in thickness direction t of the rope hoisting 2,2', their resistance against bending around an axis extending in width direction of the hoisting rope 2,2' is reduced. This is advantageous when the cross sectional area of load bearing member 3 needs to be large so as to achieve good load bearing ability and the hoisting rope 2,2' needs to be bendable around rope wheels. This is advantageous particularly in case the material of the load bearing member is hard to bend, which is the case with the composite material, and particularly so in the case of the materials as will be specified later in the description. The width/thickness—ratio of the load bearing members 3 is preferably at least 2, whereby the advantages related to the stackability and relative position of the load bearing members 3 are become clearly substantiated. However, so as to facilitate the stability of the architecture of the rope 2,2' the width/thickness—ratio of the load bearing members is preferably at least 4 (preferably even more), whereby they maintain their relative position and support each other firmly in all situations.

The hoisting rope 2,2' is also preferably belt shaped, and thereby substantially larger in width direction w than in thickness direction of the hoisting rope 2,2', whereby the total resistance thereof against bending around an axis extending in width direction w of the hoisting rope 2,2' is reduced. The width/thickness—ratio of the hoisting rope 2,2' is preferably at least 2 whereby the advantages related to the bending resistance become clearly substantial.

The group G is preferably more specifically such that the load bearing members 3 of the group G, which are next to each other in thickness direction t of the rope 2,2' have opposing sides placed against each other. These sides are shaped to form counterparts for each other, whereby they can support each other. In this example they are both planar. Said sides face each other (thereby facing in thickness direction of the rope 2,2'; upwards and downwards in FIGS. 1 and 2). In the preferred embodiments, as also illustrated in FIGS. 1 and 2, said opposing sides are flat, whereby these sides can be arranged to rest against each other with simple structure and large area, at the same time facilitating movability between them in longitudinal direction of the rope 2,2'.

At the interface between each pair of load bearing members 3, internal stresses are at least to some amount released. At the point of the interface, when the rope 2,2' is sharply bent, relative movement can take place between the load bearing members 3 next to each other in thickness direction of the rope without damaging internal structure of the load bearing members 3 of the rope, which kind of movement would not be possible with a rope provided with single load bearing member. Preferably, the load bearing members 3 are provided for moving within the hoisting rope 2,2' by sliding against each other in longitudinal direction of the hoisting rope 2,2'. This can be facilitated in one or more ways, such as by smooth shaping of the opposing sides and/or by lubrication and/or by material selection of the faces. Said opposing sides placed against each other are preferably unattached to each other so movement is allowed without breaking of an attachment between them. The load bearing members 3 next to each other in thickness direction of the rope 2,2' can move slide along each other in longitudinal direction of the rope 2,2' is allowed also due to the feature that the load bearing members 3 are not twisted together. Also due to the feature that the load bearing members 3 are not twisted together, the sliding referred to occurs only in longitudinal direction of the rope 2,2'.

To facilitate sliding between the load bearing members 3 next to each other in thickness direction t of the hoisting rope 2,2', the rope 2,2' may contain lubricant for lubricating the interface between load bearing members next to each other. Accordingly, then lubricant exists between the load bearing members 3 next to each other in thickness direction of the rope 2,2', in particular between said opposing sides placed against each other. Said opposing sides placed against each are placed against each other preferably directly with nothing but possibly a layer of lubricant between them. Lubricant or any other additional means for facilitating slidability between the load bearing members 3 is not necessary. As an alternative or additional means for facilitating slidability between the load bearing members 3, one or both of the load bearing members 3 next to each other in thickness direction may have an outer layer of low friction material, such as Teflon (Polytetrafluoroethylene; PTFE) for example, forming the side thereof which faces the load bearing member 3 next to it in thickness direction t.

The structure is more specifically such that the coating 4 comprises for each group G an inside space closed in transverse direction wherein the group G of load bearing members 3 is contained. In the preferred embodiments presented, in the inside space no other load bearing members nor any other solid components than said load bearing members of said group G are contained, which is preferable as no other components are needed for efficient and intended functioning of the solution. In the embodiments illustrated, the group G comprises only (i.e. no other load bearing members than) said load bearing members 3, which are stacked against each other in thickness direction t of the rope 2,2'. Thereby, in the group there are no load bearing members adjacent each other in width direction w of the rope 2,2'. Thus, occurrence of unnecessary chafing inside the rope 2,2' is minimized.

In the embodiment of FIG. 1, there is only one of said groups G comprised in the rope 2, and in the embodiment of FIG. 2 there are several of said groups comprised in the rope 2', in which case the groups G are adjacent each other in width direction w of the rope 2'. In the case where there are several of the groups G, the groups G are spaced apart in width direction of the rope 2,2' the coating 3 extending between groups G next to each other isolating the groups G from each other. Thereby the coating 4 forms a common coating for all of the groups G of load bearing members 3 which common coating 3 encases all these groups G. This is implemented preferably as illustrated such that the coating 3 surrounds (in transverse direction) each of said groups G and fills space(s) that exist in width direction w between adjacent groups G. In cases where there are several of the groups G, the groups G and the load bearing members 3 thereof are untwisted and parallel with each other as well as with the hoisting rope 2'.

The coating 4 is preferably elastic, whereby it allows the load bearing members 3 to move in longitudinal direction of the hoisting rope 2,2' within the rope, in particular by sliding against each other in longitudinal direction of the hoisting rope 2,2'. In each of the preferred cases, the coating 4 forms the external surface of the hoisting rope 2,2'. The coating 4 can be formed such that its shape and material suits optimally for the intended use. The coating 4 may have a contoured shape, such as polyvee pattern of longitudinal grooves and ribs, on one or both of its sides that face in thickness direction of the rope, or a tooth pattern of teeth extending across the hoisting rope 2,2' substantially in transverse direction of the hoisting rope, on one or both of its sides that face in thickness direction of the hoisting rope 2,2'. Alternatively, the coating 4 could have a further coating, should it be preferred to for the external surface of the hoisting rope 2,2' of some other material than the material of said coating 4.

The coating 3 is preferably attached to the group G of load bearing members 3. Particularly, the coating is preferably molded around the group G of load bearing members 3 such that it is attached to the periphery of the group G of load bearing members 3.

Figure 4:
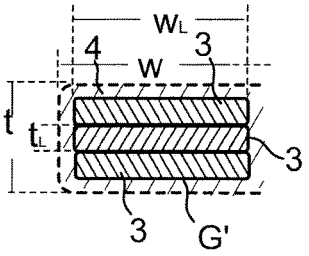
FIG. 4 illustrates a cross section of a rope as viewed in longitudinal direction of the rope according to a third embodiment.

It is preferable that the number of load bearing members 3 in a group G is at least 2 and less than 10. In the preferred embodiments illustrated in FIGS. 1 and 2, the number of load bearing members 3 in said group G is 2. FIG. 4 illustrates the configuration when the number is greater than two, in this case three. The number of load bearing members 3 is most advantageously two because in this way a considerable addition for the thickness of the load bearing cross section is obtained yet with simple structure. An advantage is that the structure is similar for both of the two load bearing members 3. Particularly, all the load bearing members, i.e. both of the two load bearing members 3, of the group G can in this way have similar coating 3 interfaces, which would not be the case when there are more than two load bearing members 3 in one group G stacked against each other. Thus, with two load bearing members 3 the coating may be attached to the wide sides of all of the load bearing members, which sides face in thickness direction of the hoisting rope 2,2' away from each other.

Figure 5A:
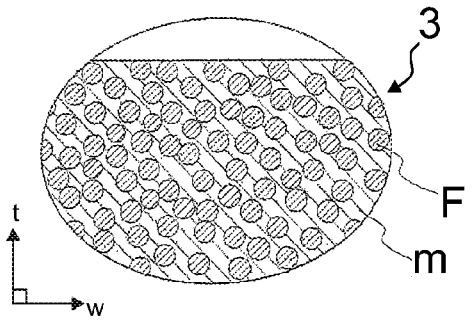
FIG. 5*a* illustrates preferred details of a cross section of a load bearing member as viewed in longitudinal direction of load bearing member and the rope.

FIG. 5*a* illustrates a preferred inner structure of the load bearing member 3, showing in particular the cross section of the load bearing member 3 as viewed in the longitudinal direction I of the load bearing member 3. As mentioned, the load bearing members 3 are made of composite material comprising reinforcing fibers F embedded in polymer matrix m. The reinforcing fibers F are more specifically distributed in polymer matrix m and bound together by the polymer matrix, particularly into an elongated rod-like piece. Thus, each load bearing member 3 is one solid elongated rodlike piece. The reinforcing fibers F are distributed preferably substantially evenly in the polymer matrix m. Thereby a load bearing member with homogeneous properties and structure is achieved throughout its cross section. In this way, it can be also ensured that each of the fibers can be in contact and bonded with the matrix m. Said reinforcing fibers F are most preferably carbon fibers, but alternatively they can be glass fibers, or possibly some other fibers. The matrix m comprises preferably epoxy, but alternative materials could be used depending on the preferred properties. Preferably, substantially all the reinforcing fibers F of each load bearing member 3 are parallel with the longitudinal direction of the load bearing member 3. Thereby the fibers are also parallel with the longitudinal direction of the hoisting rope 2,2' as each load bearing member is oriented parallel with the longitudinal direction of the hoisting rope 2,2'. This is advantageous for the rigidity as well as behavior in bending.

Figure 5B:
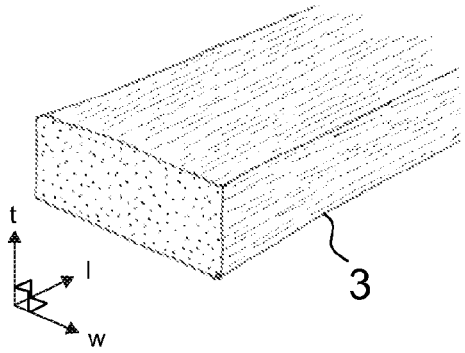
FIG. 5*b* illustrates three-dimensionally a load bearing member.

The preferred inner structure of the load bearing member 3 is preferably as described in the following, wherein the structure is explained in further preferred details by referring to FIGS. 5*a* and 5*b*. Each load bearing member 3 is an elongated rod-like piece wherein the fibers F are parallel with the longitudinal direction of the load bearing member 3, and thereby parallel with the longitudinal direction of the rope 2,2' as each load bearing member 3 is oriented parallel with the longitudinal direction of the rope 2,2'. Thereby, the fibers in the final rope 2,2' will be aligned with the force when the rope 2,2' is pulled, which ensures that the structure provides high tensile stiffness. The fibers F used in the preferred embodiments are substantially untwisted in relation to each other, which provides them said orientation parallel with the longitudinal direction of the rope 2,2'. This is in contrast to the conventionally twisted elevator ropes, where the wires or fibers are strongly twisted and have normally a twisting angle from 15 up to 30 degrees, the fiber/wire bundles of these conventionally twisted elevator ropes thereby having the potential for transforming towards a straighter configuration under tension, which provides these ropes a high elongation under tension as well as leads to an unintegral structure.

The reinforcing fibers F are preferably long continuous fibers in the longitudinal direction of the load bearing member, the fibers F preferably continuing for the whole length of the load bearing member 3 as well as the rope 2,2'. Thus, the load bearing ability as well as manufacturing of the load bearing member 3 is facilitated. The fibers F being oriented parallel with longitudinal direction of the rope 2,2', as far as possible, the cross section of the load bearing member 3 can be made to continue substantially the same in terms of its cross-section for the whole length of the rope 2,2'. Thus, no substantial relative movement can occur inside the load bearing member 3 when it is bent.

As mentioned, the reinforcing fibers F are preferably distributed in the aforementioned load bearing member 3 substantially evenly, in particular as evenly as possible, so that the load bearing member 3 would be as homogeneous as possible in the transverse direction thereof. An advantage of the structure presented is that the matrix m surrounding the reinforcing fibers F keeps the interpositioning of the reinforcing fibers F substantially unchanged. It equalizes with its slight elasticity the distribution of a force exerted on the fibers, reduces fiber-fiber contacts and internal wear of the rope, thus improving the service life of the rope 2,2'. The composite matrix m, into which the individual fibers F are distributed as evenly as possible, is most preferably made of epoxy, which has good adhesiveness to the reinforcement fibers F and which is known to behave advantageously with carbon fiber. Alternatively, e.g. polyester or vinyl ester can be used, but alternatively any other suitable alternative materials can be used. FIG. 5*a* presents a partial cross-section of the load bearing member 3 close to the surface thereof as viewed in the longitudinal direction of the rope 2,2' presented inside the circle in the Figure, 5*a* according to which cross-section the reinforcing fibers F of the load bearing member s 3 are preferably organized in the polymer matrix m. The rest (parts not showed) of the load bearing member 3 have a similar structure. FIG. 5*a* presents also how the individual reinforcing fibers F are substantially evenly distributed in the polymer matrix m, which surrounds the reinforcing fibers F and which is fixed to the reinforcing fibers F. The polymer matrix m fills the areas between individual reinforcing fibers F and binds substantially all the reinforcing fibers F that are inside the matrix m to each other as a uniform solid substance. A chemical bond exists between, the individual reinforcing fibers F (preferably each of them) and the matrix m, one advantage of which is uniformity of the structure. To improve the chemical adhesion of the reinforcing fiber to the matrix m, in particular to strengthen the chemical bond between the reinforcing fiber F and the matrix m, each fiber can have a thin coating, e.g. a primer (not presented) on the actual fiber structure between the reinforcing fiber structure and the polymer matrix m. However, this kind of thin coating is not necessary. The properties of the polymer matrix m can also be optimized as it is common in polymer technology. For example, the matrix m can comprise a base polymer material (e.g. epoxy) as well as additives, which fine-tune the properties of the base polymer such that the properties of the matrix are optimized. The polymer matrix m is preferably of a hard non-elastomer as in this case a risk of buckling can be reduced for instance. However, the polymer matrix need not be non-elastomer necessarily, e.g. if the downsides of this kind of material are deemed acceptable or irrelevant for the intended use. In that case, the polymer matrix m can be made of elastomer material such as polyurethane or rubber for instance. The reinforcing fibers F being in the polymer matrix means here that the individual reinforcing fibers F are bound to each other with a polymer matrix m, e.g. in the manufacturing phase by immersing them together in the fluid material of the polymer matrix which is thereafter solidified. In this case the gaps of individual reinforcing fibers bound to each other with the polymer matrix comprise the polymer of the matrix. In this way a great number of reinforcing fibers bound to each other in the longitudinal direction of the rope are distributed in the polymer matrix. As mentioned, the reinforcing fibers are preferably distributed substantially evenly in the polymer matrix m, whereby the load bearing member is as homogeneous as possible when viewed in the direction of the cross-section of the rope. In other words, the fiber density in the cross-section of the load bearing member 3 does not therefore vary substantially.

The reinforcing fibers F together with the matrix m form a uniform load bearing member, inside which abrasive relative movement does not occur when the rope is bent. The individual reinforcing fibers of the load bearing member 3 are mainly surrounded with polymer matrix m, but random fiber-fiber contacts can occur because controlling the position of the fibers in relation to each other in their simultaneous impregnation with polymer is difficult, and on the other hand, perfect elimination of random fiber-fiber contacts is not necessary from the viewpoint of the functioning of the solution. If, however, it is desired to reduce their random occurrence, the individual reinforcing fibers F can be pre-coated with material of the matrix m such that a coating of polymer material of said matrix is around each of them already before they are brought and bound together with the matrix material, e.g. before they are immersed in the fluid matrix material.

As above mentioned, the matrix m of the load bearing member 3 is most preferably hard in its material properties. A hard matrix m helps to support the reinforcing fibers f, especially when the rope bends, preventing buckling of the reinforcing fibers F of the bent rope, because the hard material supports the fibers F efficiently. To reduce the buckling and to facilitate a small bending radius of the load bearing member 3, among other things, it is therefore preferred that the polymer matrix m is hard, and in particular non-elastomeric. The most preferred materials for the matrix are epoxy resin, polyester, phenolic plastic or vinyl ester. The polymer matrix m is preferably so hard that its module of elasticity (E) is over 2 GPa, most preferably over 2.5 GPa. In this case the module of elasticity E is preferably in the range 2.5-10 GPa, most preferably in the range 2.5-3.5 GPa. There are commercially available various material alternatives for the matrix m which can provide these material properties. Preferably over 50% of the surface area of the cross-section of the load bearing member 3 is of the aforementioned reinforcing fiber, preferably such that 50%-80% is of the aforementioned reinforcing fiber, more preferably such that 55%-70% is of the aforementioned reinforcing fiber, and substantially all the remaining surface area is of polymer matrix. Most preferably, this is carried out such that approx. 60% of the surface area is of reinforcing fiber and approx. 40% is of matrix material (preferably epoxy material). In this way a good longitudinal stiffness for the load bearing member 3 is achieved. As mentioned carbon fiber is the most preferred fiber to be used as said reinforcing fiber due to its excellent properties. However, this is not necessary as alternative fibers could be used, such as glass fiber, which has been found to be suitable for the hoisting rope as well.

In the illustrated embodiments, the load bearing members 3 are substantially rectangular. However, this is not necessary as alternative shapes could be used. Likewise, it is not necessary that all the load bearing members 3 of one group G are similar in cross section, as is the case in the illustrated embodiments. Alternatively load bearing members different in cross section could be stacked against each other in thickness direction of the rope, although it is preferable also in this case that the load bearing members next to each other in thickness direction have opposing sides (facing in thickness direction of the rope) placed against each other, which sides are shaped to form counterparts for each other. Then, one of the sides could be concave shaped and the other convex shaped, for instance.

Figure 6:
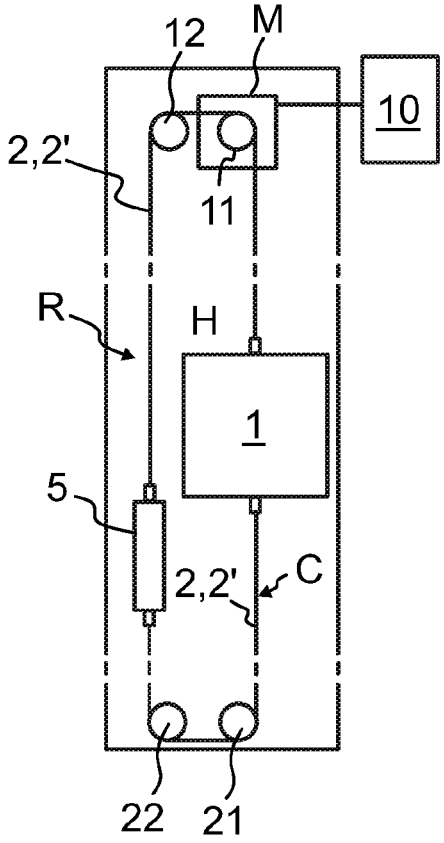
FIG. 6 illustrates schematically an elevator according to an embodiment of the invention as viewed from the side The foregoing aspects, features and advantages of the invention will be apparent from the drawings and the detailed description related thereto.

FIG. 6 illustrates a preferred embodiment of an elevator, which comprises a hoistway H; an elevator car 1 vertically movable in the hoistway H and a counterweight 5 vertically movable in the hoistway H. The elevator comprises a roping R comprising one or more hoisting ropes 2,2' interconnecting the elevator car 1 and the counterweight 5. The elevator comprises one or more upper rope wheels 11,12 mounted higher than the car 1 and the counterweight 5, in this case particularly in proximity of the upper end of the hoistway H. In this case there are two of said rope wheels 11,12 but the elevator could be implemented also with some other number of rope wheels 11,12. Each of said one or more hoisting ropes 2,2' pass around said one or more rope wheels 11, 12 mounted in proximity of the upper end of the hoistway H. In this case the one or more rope wheels 11, 12 are mounted inside the upper end of the hoistway, but alternatively they could be mounted inside a space beside or above the upper end of the hoistway H. Said one or more rope wheels 11, 12 comprise a drive wheel 11 engaging said one or more hoisting ropes 2,2' and the elevator comprises a motor M for rotating the drive wheel 11. Thus, the elevator car 1 can be moved. The elevator further comprises an elevator control unit 10 for automatically controlling rotation of the motor M. Thereby also the movement of the car 1 is automatically controllable. Each hoisting rope 2,2' is as described in context of FIGS. 1 to 5, and thereby each hoisting rope 2,2' has a longitudinal direction l, thickness direction t and width direction w. Each hoisting rope 2,2' comprising a group G of load bearing members 3; and a coating 4 encasing said group G of load bearing members 3; wherein the load bearing members 3 extend inside the coating 4 parallelly and in an untwisted manner and unbroken throughout the length of the rope 2,2'. The load bearing members 3 are belt-shaped, in particular substantially larger in width direction than in thickness direction of the rope 2,2', and made of composite material comprising reinforcing fibers F in polymer matrix (m), and stacked against each other in thickness direction t of the rope 2,2'. The load bearing members 3 being substantially larger in width direction w than in thickness direction t of the hoisting rope 2,2', they become easy to stack against each other in thickness direction t of the rope 2,2' as well as maintain the architecture of the rope unchanged during use of the rope. Furthermore, the load bearing members 3 being substantially larger in width direction w than in thickness direction t of the hoisting rope 2,2', their resistance against bending around an axis extending in width direction of the rope is reduced. This is advantageous when the cross sectional area of load bearing member 3 needs to be large so as to achieve good load bearing ability and the rope needs to be bendable around rope wheels. This is advantageous particularly in case the material of the load bearing member is hard to bend, which is the case with the composite material. As mentioned, the hoisting rope 2,2' is also preferably larger in width direction w than in thickness direction of the hoisting rope 2,2', whereby the total resistance thereof against bending around an axis extending in width direction of the hoisting rope 2,2' is reduced.

So as to utilize the rope features facilitating rope bending, the hoisting ropes 2,2' are arranged such that each of said one or more hoisting ropes 2,2' passes around the one or more rope wheels 11, 12 the side thereof which faces in thickness direction t and extends in width direction w of the of the hoisting rope 2,2', rests against the rope wheel 11, 12. Each hoisting rope passes around the one or more rope wheels 11, 12 turning around an axis extending in width direction w of the hoisting rope 2,2'. The reinforcing fibers F of the composite members are preferably carbon fibers, which are light-weighted and possess excellent load-bearing ability in longitudinal direction. Thereby, the elevator has excellent properties in terms of lifting capacity and energy-efficiency.

The elevator illustrated in FIG. 6 comprises in addition to said roping R, a second roping C interconnecting the elevator car 1 and the counterweight 5. Also this roping C can have ropes 2,2' as described elsewhere in the application. For this roping C, the elevator comprises one or more lower rope wheels 21,22 mounted lower than the car 1 and the counterweight 5, in this case particularly in proximity of the lower end of the hoistway H. In this case there are two of said rope wheels 21,22, but the elevator could be implemented also with some other number of rope wheels 21,22. Each of said one or more hoisting ropes 2,2' pass around said one or more rope wheels 11, 12 mounted in proximity of the upper end of the hoistway H. In this case the one or more rope wheels 11, 12 are mounted inside the lower end of the hoistway H.

In the application only elevator has been presented as a hoisting apparatus utilizing the hoisting rope 2,2'. However, the hoisting rope 2,2' could be utilized in some other type of hoisting apparatus, such as a crane.

As mentioned, it is preferable that the number of load bearing members 3 in a group G is at least 2 and less than 10. With small number of load bearing members 3 in a group G, a considerable addition for the thickness of the load bearing cross section is obtained with simple structure. When the number of load bearing members is within the above given range of at least 2 and less than 10 (i.e. 2, 3, 4, 5, 6, 7, 8 or 9), the thickness of each individual load bearing member is preferably within range 0.5-4 mm, their combined thickness then preferably being between 1 to 20 mm, whereby a rope best suitable for elevator is obtained in particular due to its behavior in bending. However, the above given range of at least 2 and less than 10 need not necessarily be realized as the number could be alternatively be even greater, such as up to one hundred, when a more complicated structure is acceptable. In case the number is greater than said at least 2 and less than 10 the thickness of each individual load bearing member is preferably smaller than above mentioned, most preferably within range 0.1-2 mm, their combined thickness then preferably again being between said 1 to 20 mm.

It is to be understood that the above description and the accompanying Figures are only intended to teach the best way known to the inventors to make and use the invention. It will be apparent to a person skilled in the art that the inventive concept can be implemented in various ways. The above-described embodiments of the invention may thus be modified or varied, without departing from the invention, as appreciated by those skilled in the art in light of the above teachings. It is therefore to be understood that the invention and its embodiments are not limited to the examples described above but may vary within the scope of the claims and their equivalents.

What is claimed is:

1. A hoisting rope for a hoisting apparatus, the hoisting rope having a longitudinal direction, a thickness direction and a width direction, and comprising:

at least one group of load bearing members made of composite material comprising reinforcing fibers embedded in polymer matrix; and a coating encasing said at least one group of load bearing members, wherein said load bearing members extend in an untwisted manner inside the coating parallel with each other as well as with the longitudinal direction of the rope throughout a length thereof, said load bearing members being substantially larger in the width direction than in the thickness direction of the rope and stacked against each other in the thickness direction of the rope, wherein the load bearing members next to each other in the thickness direction have opposing sides placed against each other, which sides are shaped to form counterparts for each other, and wherein the load bearing members have a first side of the opposing sides with a concave shape and a second side of the opposing sides, opposite to the first side, with a convex shape.

2. The hoisting rope according to claim 1, wherein a number of load bearing members in said at least one group is at least 2.

3. The hoisting rope according to claim 1, wherein a number of load bearing members in said at least one group is 2.

4. The hoisting rope according to claim 1, wherein the rope is substantially larger in the width direction than in the thickness direction, and wherein a width/thickness ratio of the rope is at least 2.

5. The hoisting rope according to claim 1, wherein a width/thickness ratio of the load bearing members is at least 2.

6. The hoisting rope according to claim 1, wherein the load bearing members are provided for moving relative to each other within the hoisting rope by sliding against each other in the longitudinal direction of the hoisting rope.

7. The hoisting rope according to claim 1, wherein said opposing sides are unattached to each other.

8. The hoisting rope according to claim 1, wherein the rope contains lubricant for lubricating an interface between load bearing members next to each other in the thickness direction of the rope.

9. The hoisting rope according to claim 1, wherein one or both of the load bearing members next to each other in the thickness direction has/have an outer layer comprised of polytetrafluoroethylene (PTFE), forming the side thereof which faces the load bearing member next to it in the thickness direction of the rope.

10. The hoisting rope according to claim 1, wherein said reinforcing fibers are carbon fibers.

11. The hoisting rope according to claim 1, wherein the coating comprises for the at least one group an inside space closed in the width direction of the rope, in which inside space said at least one group of load bearing members is contained, and in the inside space no other load bearing members than said load bearing members of said at least one group are contained.

12. The hoisting rope according to claim 1, wherein the module of elasticity E of said polymer matrix is over 2 GPa.

13. The hoisting rope according to claim 1, wherein the rope comprises a plurality of groups of load bearing members spaced apart from one another in the width direction of the rope via the coating.

14. The hoisting rope according to claim 13, wherein a number of load bearing members in each group is at least 5.

15. The hoisting rope according to claim 13, wherein the rope is substantially thinner in the width direction than in the thickness direction, a width/thickness ratio of the rope being at least two.

16. The hoisting rope according to claim 13, wherein a number of load bearing members in each group is less than 10.

17. The hoisting rope according to claim 13, wherein a number of load bearing members in each group is 2 or 3.

18. An elevator, comprising:

a hoistway;

an elevator car vertically movable in the hoistway;

a counterweight vertically movable in the hoistway; and a roping comprising one or more ropes as defined in claim 1, each interconnecting the elevator car and counterweight.

* * * * *